US006247749B1

(12) United States Patent
Yu

(10) Patent No.: US 6,247,749 B1
(45) Date of Patent: Jun. 19, 2001

(54) FOLDING CHAIR WITH UPRIGHT TELESCOPIC SUPPORTS

(76) Inventor: James C. W. Yu, 15977 - 113A Avenue, Surrey, British Columbia (CA), V4N 1R6

( * ) Notice: Subject to any disclaimer, the term of this patent is extended or adjusted under 35 U.S.C. 154(b) by 0 days.

(21) Appl. No.: 09/552,662

(22) Filed: Apr. 19, 2000

(51) Int. Cl.[7] ..... A47C 4/48
(52) U.S. Cl. ..... 297/16.2; 297/45
(58) Field of Search ..... 297/16.1, 16.2, 297/45, 59; 248/764

(56) References Cited

U.S. PATENT DOCUMENTS 2,096,237 * 10/1937 Frey ..... 297/45
2,486,015 * 10/1949 Everest et al. ..... 297/45
4,934,638 * 6/1990 Davis ..... 248/164
6,082,813 * 7/2000 Chen ..... 297/16.2

FOREIGN PATENT DOCUMENTS

787187 * 9/1935 (FR) ..... 297/45

* cited by examiner

*Primary Examiner*—Peter R. Brown
(74) *Attorney, Agent, or Firm*—Anthony C. Edmonds

(57) ABSTRACT

A folding chair of the type having a frame constructed of pivotally connected scissors like "X"-shaped structure strut members supporting a sling seat, the lower ends of which form two front feet and two rear feet and the upper ends of which form two front seat corners and two rear seat corners of the chair. The folding chair includes a pair of upright telescopic supports mounted between the two front seat corners and the two front feet. The upright telescopic supports extend when the frame is folded and collapse telescopically when the chair is deployed. A pair of uprights may extend up from the rear feet and through the rear seat corners so as to extend above the rear of the sling seat to provide a backrest.

11 Claims, 9 Drawing Sheets

FOLDING CHAIR WITH UPRIGHT TELESCOPIC SUPPORTS

FIELD OF THE INVENTION

This invention relates to folding chairs using an X-frame folding design, and more specifically the addition of a telescopic support, which allow the use of an X-frame folding design to substantially support a person of above average weight, without bending the frame structure under regular and harsh use.

BACKGROUND OF THE INVENTION

Lightweight, foldable stools and chairs are used in camping and other outdoor uses because they can easily be carried, stored compactly and are quick and easy to setup.

Some of the simplest devices for portable seating have been triangular or square seats stools with 3 and 4 legs. These simple designs are light compact, but lack strength and also comfort because they cannot easily have a back support.

There are many varieties in prior art, showing a constant trend to improve upon weight, foldability, portability and comfort. One such variety is illustrated in FIG. 1.

Inventor is aware of U.S. Pat. No. 4,184,711 issued to Wakimoto Jan. 22, 1980, a four-legged chair with the legs pivotally-coupled by an external center hinge and two back support uprights each hinged separately to a leg. Wakimoto's patent offers improved compactness by eliminating the horizontal seat supports. However, the external center hinge and back support tubes would not adequately support the weight of a large person.

Inventor is also aware U.S. Pat. No. 4,290,643 issued to Logan Sep. 22, 1981, a folding chair comprising a complicated network of eight rigid members, six tension cables, and a complex fabric cover. Although the closed bundle folds in a substantially parallel arrangement for collapsibility, the complex fabric cover can easily be stressed, especially after the material has been exposed to the sunlight over time. Also, it is not seen as an improvement over prior art in regards to ease of assembly.

Inventor is also aware U.S. Pat. No. 4,595,232 to Glenn et al. Jun. 17, 1986 which shows a four-legged chair with legs put together as two front-to-back X-shaped frames, two side-to-side horizontal seat supports connecting the X-frames, and two posts extending upright from leg sockets to hold a fabric backrest. A "spacer bar" reinforces the posts above the backrest to eliminate the flex of Wakimoto's art but adds a hard surface causing user discomfort. However, this design does not improve the collapsibility or lightweight features of existing art. Also, the frame design would not be stable under a heavy person.

Inventor is also aware U.S. Pat. No. 4,807,930 to Helfrich Feb. 28, 1989, which shows a four-legged chair with legs, put together using four X-shaped frames, supporting a fabric seat and a fabric backrest, but would be limited in its ability to handle the weight of a large person or the abruptness of a person dropping or plopping down onto the chair.

Inventor is also aware U.S. Pat. No. 5,718,473 issued to Lynch Feb. 17, 1998, which is lightweight and collapsible chair, but would also be limited in its ability to handle the weight of a large person or the abruptness of a person plopping down onto the chair.

SUMMARY OF THE INVENTION

Accordingly, it is an object of this invention to provide a folding chair, which collapses to a compact package for carrying.

It is another object of this invention to provide a folding chair, which is lightweight and convenient for carrying, yet strong enough to support a person of above average weight, without bending the frame structure under normal use.

It is another object of this invention to provide a folding chair, which can be fixedly deployed so that the seat is held taut.

It is yet another object of this invention to provide a folding chair, where the seat is held taut and as such can be used as a stool or a small table.

It is still another object of this invention to provide a folding chair that is inexpensive to manufacture and consequently cost effective for a wide number of recreational activities.

A folding chair of the type having a frame constructed of pivotally connected scissors-like "X"-shaped structure strut members supporting a sling seat, the lower ends of which form two front feet and two rear feet and the upper ends of which form two front seat corners and two rear seat corners of the chair. The folding chair includes a pair of upright telescopic supports attaching at the two front seat corners towards the two front feet, where upright telescopic supports extend when the frame is folded and withdraw into themselves when the chair is deployed, thereby allowing the frame to support greater weight in use without adding bulk to the folded frame for simple storage or transport. The chair quickly deploys by spreading the front feet, thereby causing the rear feet to spread apart and to extend rearwardly from the front feet. There may also be a pair of uprights extending up from the rear feet and extending through the rear seat corners to extend above the rear of the seat to function as upright supports for a chair seat backrest.

In summary the folding chair of the present invention includes "X"-shaped collapsible front and rear structures, and "X"-shaped collapsible left and right side structures.

The front, rear, left side and right side structures are pivotally mounted to each other at adjoining corners of the "X"-shaped structures so that the front and rear structures are parallel and spaced apart and so that the left and right side structures are parallel and spaced apart, and so that the front, rear, left and right side structures when so mounted to each other define a rectangular parallelepiped symmetric about an axis of symmetry. The rectangular parallelepiped is expandable or collapsible symmetrically about the axis of symmetry by simultaneous corresponding expansion or collapsing of the "X"-shaped structures about pivots in the center of each the "X"-shaped structure and about the pivotable mounting at the adjoining corners. The adjoining corners form the vertices of the rectangular parallelepiped. The improvement of the present invention resides in at least one telescopic member mounted between vertically aligned vertices of the rectangular parallelepiped. The telescopic member is sized so that when it is fully telescopically retracted, that is, an extendible rod is retracted into a sleeve of larger diameter, the rectangular parallelepiped is fully expanded so as to tension a flexible seat suspended between upper vertices of the rectangular parallelepiped, Advantageously, at least one telescopic member is mounted between vertically aligned front vertices of the rectangular parallelepiped.

Further advantageously, the at least one telescopic member may be a pair of parallel linearly telescopic members telescopically extendable and retractable between fully extended positions when the rectangular parallelepiped is fully collapsed about the axis of symmetry, and fully retracted positions when the rectangular parallelepiped is fully expanded.

The folding chair of the present invention may also be summarized as including:

a) a front transverse "X"-shaped structure formed by first and second rigid members pivotally coupled scissor-like together at midpoints along the first and second members and extending downwardly to front feet and upwardly to front seat corners of the chair;

b) a rear transverse "X"-shaped structure formed by third and fourth rigid members pivotally coupled scissor-like together at midpoints along the third and fourth members and extending downwardly to rear feet and upwardly to rear seat corners of the chair;

c) left and right side "X"-shaped structures each a scissor-like pivotally coupled pair of crossed rigid members, each pair of crossed rigid members having upper and lower oppositely disposed ends pivotally mounted to corresponding ends of the first, second, third and fourth rigid members when the front and rear transverse "X"-shaped structures and the left and right "X"-shaped structures are mounted to one another so as to define a rectangular parallelepiped between the corresponding ends, a sling seat mounted between upper vertices thereof;

wherein the improvement resides in at least one telescopic upright support mounted between a front corner of the sling seat and a front foot of the front feet, the front corner of the sling seat and the front foot substantially vertically aligned.

The folding chair of the present invention may also include rear uprights mounted to the rear feet and slidably mounted to rear seat corners of the sling seat. The rear uprights may extend above the sling seat to support a backrest mounted therebetween. The folding chair of the present invention is intended to include chairs, stools, folding tables and the like, all collectively alternatively referred to herein as chairs. Thus in a cross-legged scissor-legged folding chair such as found in the prior art, the improvement of the present invention resides in an improved leg supporting apparatus comprising a first upstanding telescopic member mounted between a first corner of a seat portion of the chair and a first foot of the chair, wherein the first upstanding telescopic member telescopically is retracted into a fully retracted position when the chair is unfolded so as to be fully deployed.

The folding chair of the present invention may further comprise a second upstanding telescopic member mounted between a second comer of the seat portion and a second foot of the chair, when the second upstanding telescopic member telescopically is retracted into a fully retracted position when the chair is unfolded so as to be fully deployed. Further telescopic upright members may be mounted between the remaining seat corners and feet.

Advantageously, the first comer is a front comer and the first foot is a front foot. Similarly, the first and second corners may be front corners and the first and second feet may be front feet. Further advantageously, the first and second upstanding telescopic members are vertical.

In one embodiment one ore more of the upstanding telescopic members include a releasable lock mounted thereon or therein to releasably lock the upstanding telescopic member in the fully retracted position.

BRIEF DESCRIPTION OF THE DRAWINGS

Various other objects, features and advantages of the present invention will become more fully appreciated as the same becomes better understood when considered in conjunction with the following detailed description of an illustrative embodiment and the accompanying drawings, in which like reference characters designate the same or similar parts throughout the several views, and wherein.

DETAILED DESCRIPTION OF PREFERRED EMBODIMENTS

Figure 1:
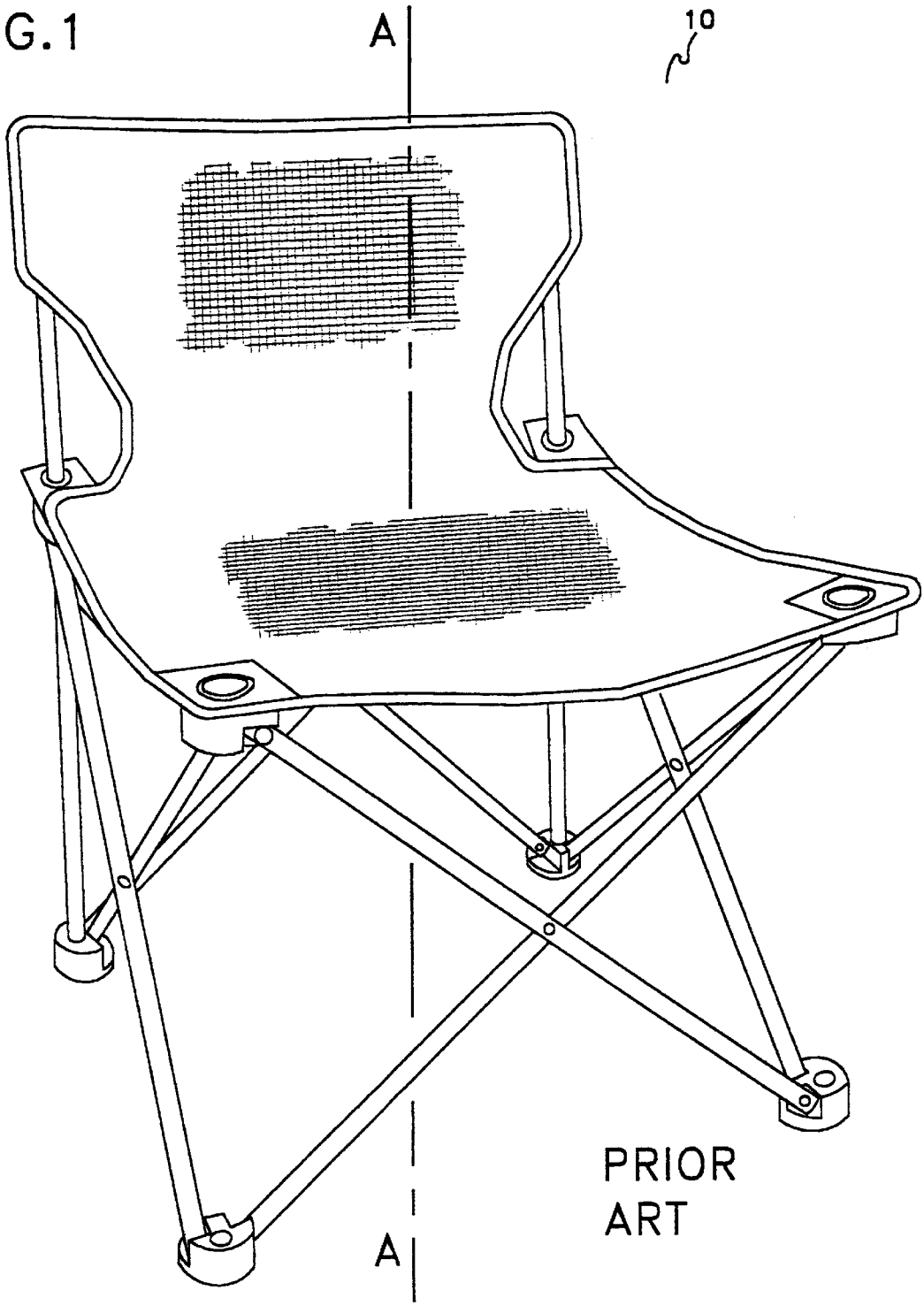
FIG. 1 is a perspective view of prior art folding chair.
Figure 2:
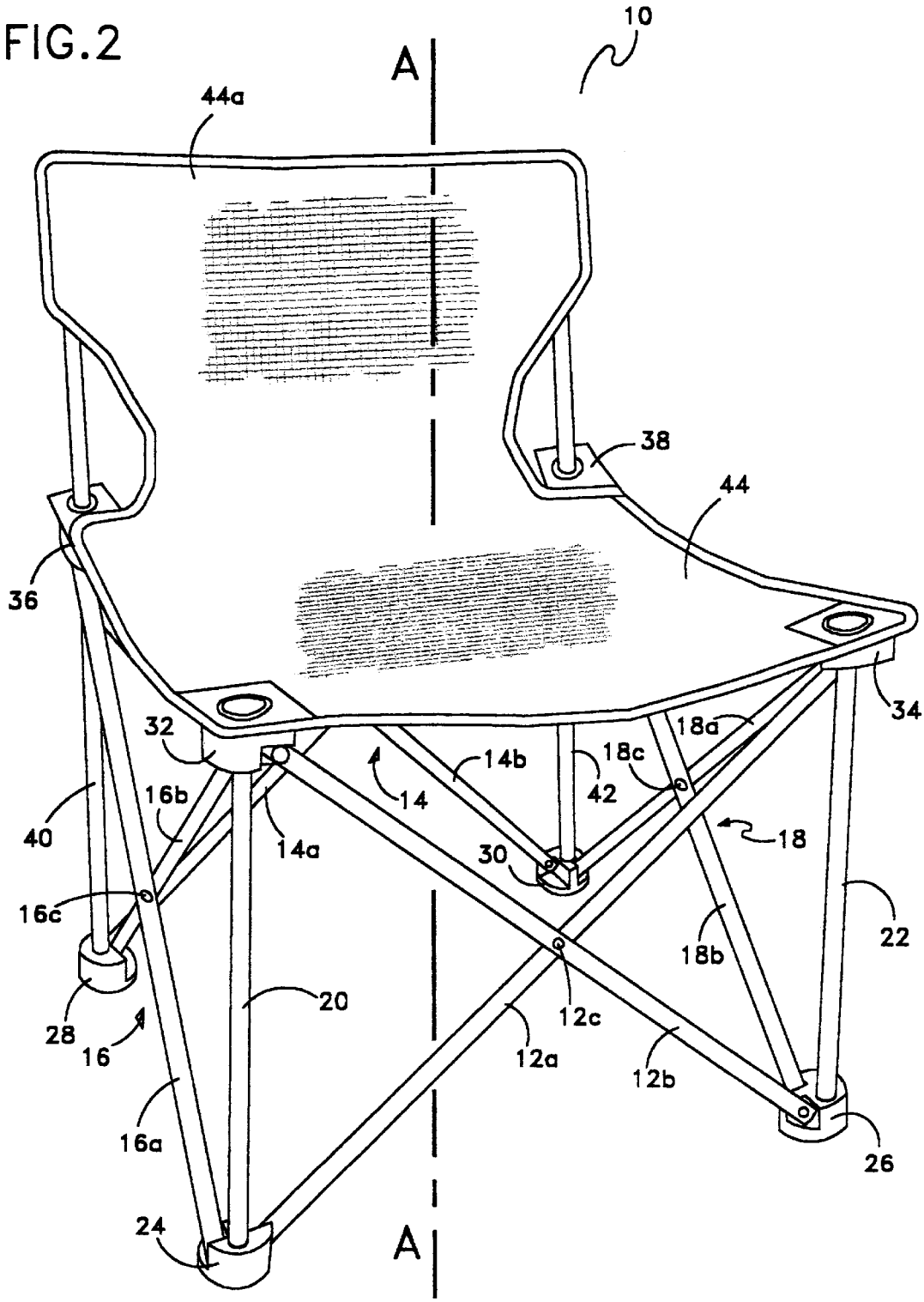
FIG. 2 is a perspective view of the folding chair of the present invention with telescopic supports and showing the chair deployed.
Figure 3:
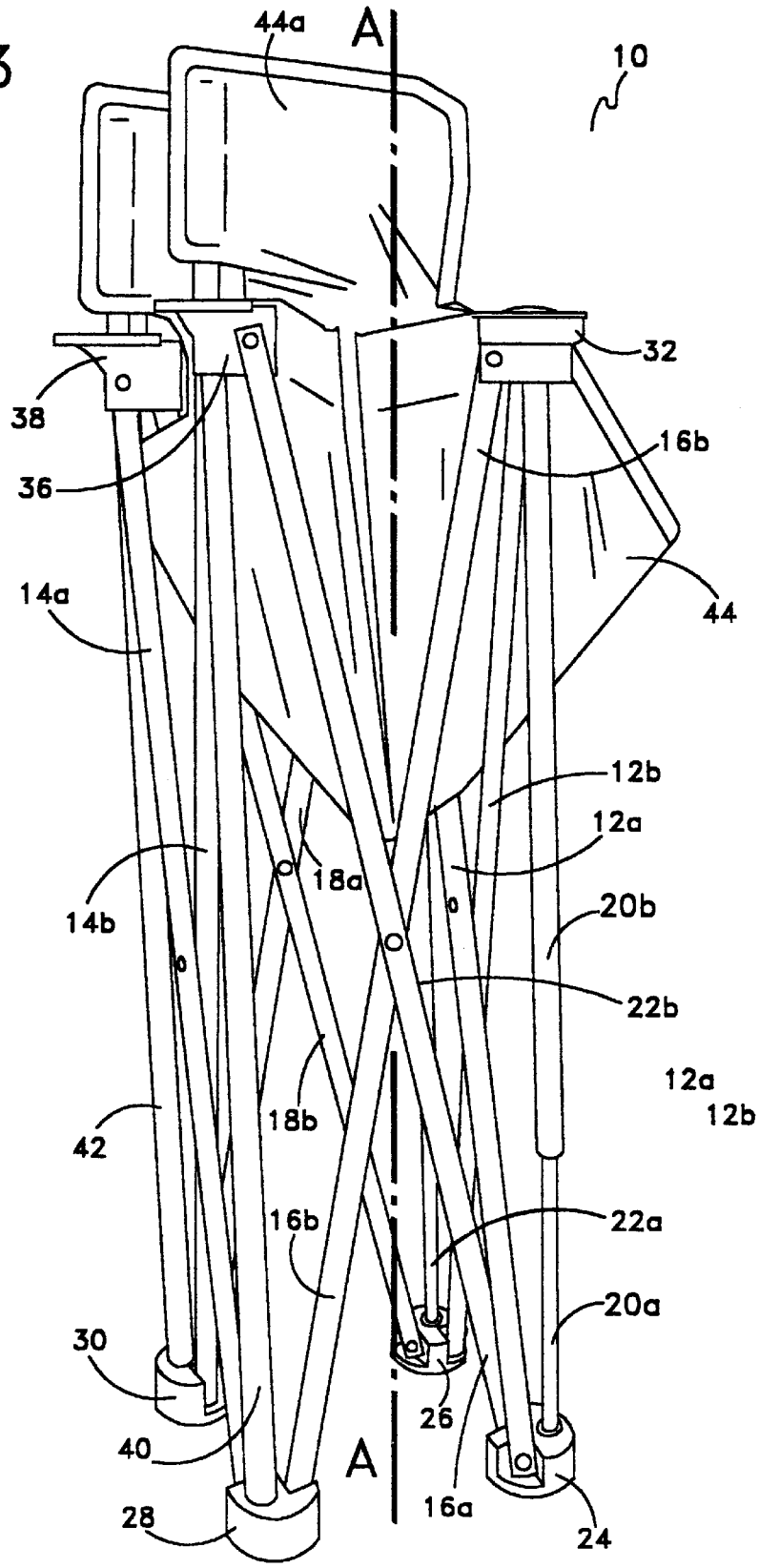
FIG. 3 is a perspective view of the folding chair of the present invention with telescopic Supports extended and showing the chair mostly folded.
Figure 4A:
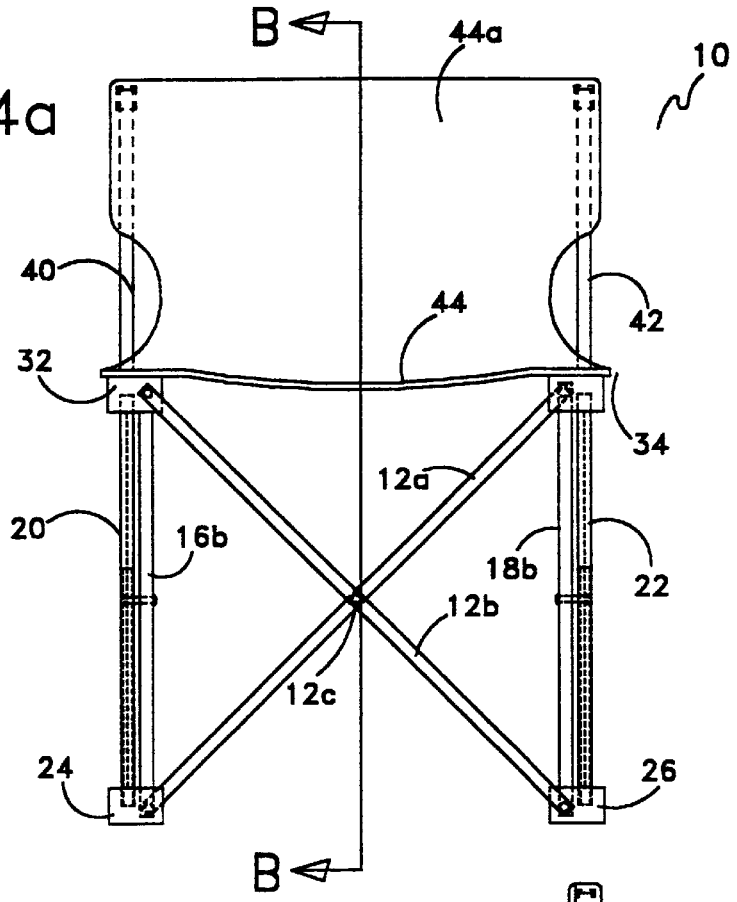
FIG. 4*a* is a front elevation view of the present invention with telescopic supports and showing the chair deployed.
Figure 4B:
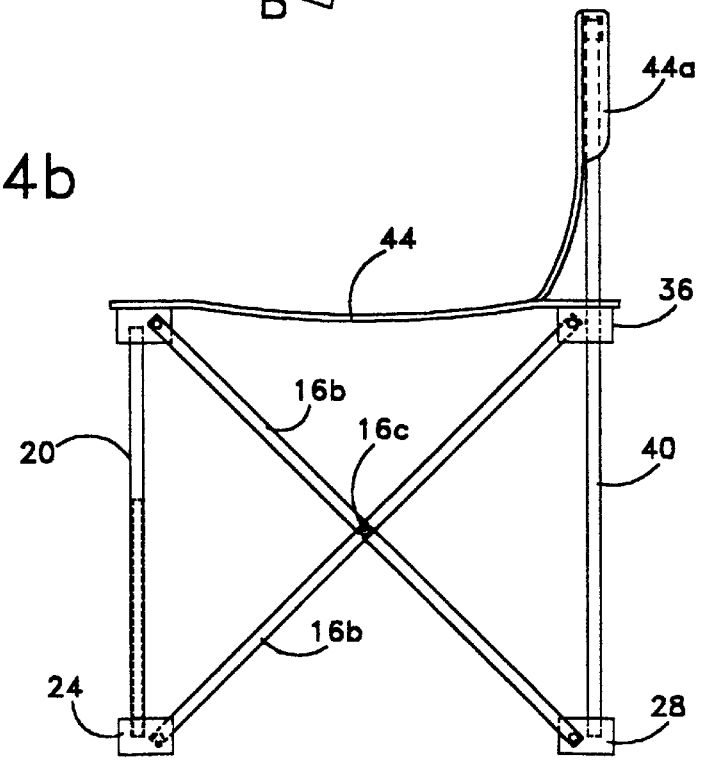
FIG. 4*b* is a section view of the side of the present invention taken from FIG. 4*a* taken along line B.
Figure 5A:
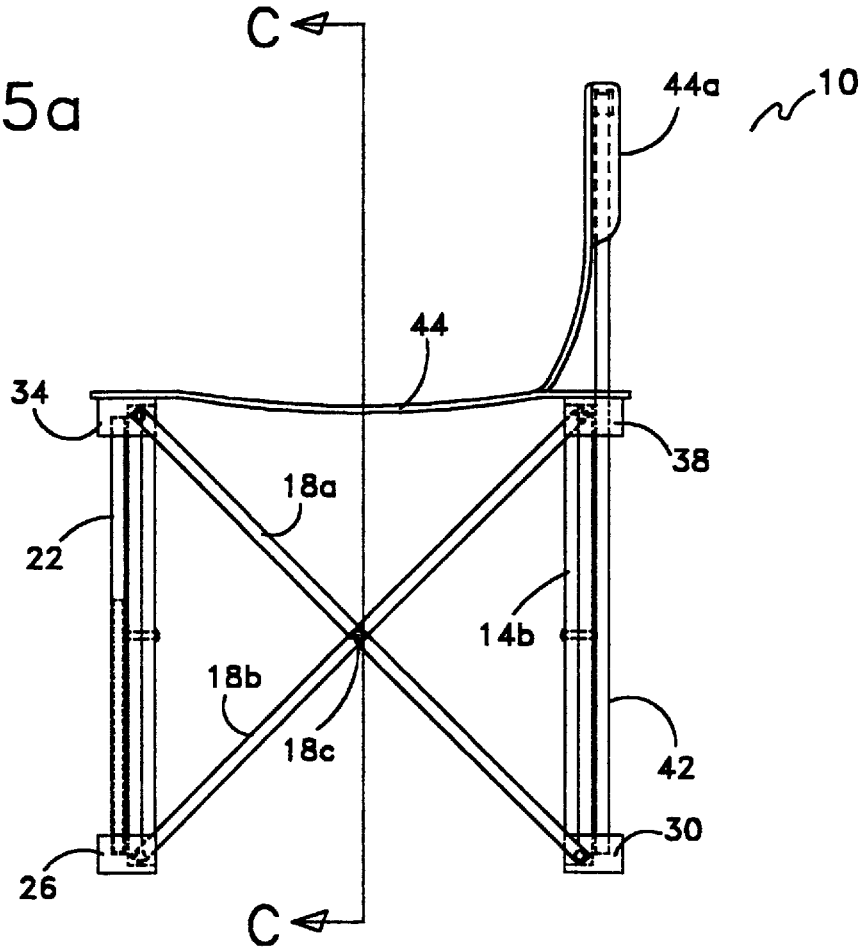
FIG. 5*a* is a side elevation view of the present invention with telescopic supports and showing the chair deployed.
Figure 5B:
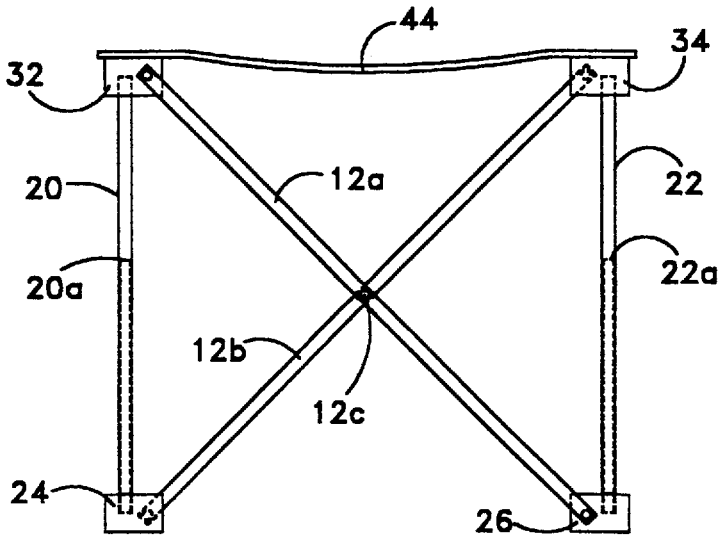
FIG. 5*b* is a section view of the front of the present invention taken from FIG. 5*a* taken along line C.

Folding chair 10 is shown deployed ready for use in FIG. 2. Folding chair 10 collapses as seen partially collapsed in FIG. 3. Folding chair 10 may be described as having four frame structures, namely, a front "X"-shaped structure 12, and a rear "X"-shaped structure 10 14, and two side "X"-shaped structures 16 and 18 respectively. The corners of the front "X"-shaped structure are pivotally mounted to the front corners of the side "X"-shaped structures. The corners of the rear "X"-shaped structure are pivotally mounted to the rear corners of the side "X"-shaped structures. Thus in the prior art folding seat of FIG. 1, and folding seat 10 of the present invention, when the seats are deployed ready for use, the "X"-shaped structures are spread horizontally until their uppermost corners are restrained from further movement by tensioning of the fabric of the seat suspended between the uppermost corners of all four "X"-shaped structures.

As also seen in FIGS. 4*a*, 4*b*, 5*a*, 5*b* and 6, each "X"-shaped structure is comprised of two elongate rigid members pivotally mounted to each other midway along their lengths. "X"-shaped structure 12 has rigid members 12*a* and 12*b* pivotally mounted to each other by means of pin 12*c*. "X"-shaped structure 14 has rigid members 14*a* and 14*b* pivotally mounted to each other by pin 14*c*. Left side "X"-shaped structure 16 has rigid members 16*a* and 16*b* pivotally mounted to one another by pin 16*c*. Right side "X"-shaped structure has rigid members 18*a* and 18*b* pivotally mounted to one another by pin 18*c*. The four "X"- shaped structures 12, 14, 16 and 18 form a symmetric structure about axis A. The "X"-shaped structures remain symmetrically disposed about axis A during collapsing and deployment of the structure.

The improvement over the prior art resides in the addition of at least two telescoping vertical supports 20 and 22. Vertical support 20 is rigidly mounted between front seat comer 32 and front foot 24. Vertical support 22 is rigidly mounted between front seat corner 34 and front foot 26. The upper end of member 12*b* is pivotally mounted to seat comer 32 and the lower end of member 12*a* is pivotally mounted to foot 24 for pivotable motion relative to vertical support 20 in the plane containing front "X"-shaped structure 12. Similarly, the upper end of member 12*a* is pivotally mounted to seat comer 34 and the lower end of member 12*b* is pivotally mounted to foot 26 for pivotable motion in the plane containing front "X"-shaped structure 12.

Rear "X"-shaped structure 14 is parallel to front "X"-shaped structure 12. The upper end of member 14*b* is pivotally mounted to rear seat corner 36 and the lower end of member 14*a* is pivotally mounted to rear foot 28. Rear seat comer 36 is slidably mounted on post 40. The lowermost end of post 40 is rigidly mounted to foot 28. The upper end of post 40 supports one side of the webbing of seat back 44*a*. The upper end of member 14*b* and the lower end of member 14*a* pivot relative to seat comer 36 and foot 28 respectively in the plane containing rear "X"-shaped structure 14. The upper end of member 14*a* is pivotally mounted to rear seat comer 38. The lower end of member 14*b* is pivotally mounted to rear foot 30. Rear seat comer 38 is slidably mounted on vertical post 42. Vertical post 42 is rigidly mounted at its lowermost end to foot 30. Post 42 at its upper end supports the other side of the webbing of seat back 44*a*, that is, oppositely disposed to vertical post 40 across the back of the seat.

Left and right side "X"-shaped structures 16 and 18 respectively are pivotally mounted at the uppermost ends of their respective rigid members 16*a* and 16*b*, and 18*a* and 18*b*, to the seat corners 36, 32, and 34 and 38 respectively. They are pivotally mounted for pivotable rotation in the planes containing side "X"-shaped structures 16 and 18 respectively. Similarly, the lowermost ends of members 16*a* and 16*b* are pivotally mounted to feet 24 and 28 respectively, and the lowermost ends of members 18*a* and 18*b* are pivotally mounted to feet 30 and 26 respectively, for pivotal movement in the plane containing side "X"-shaped structures 16 and 18 respectively.

Telescoping vertical supports 20 and 22 telescope between a fully extended length and a fully collapsed length. The fully extended length generally corresponds to the corresponding distances between foot 28 and seat comer 36, and between foot 30 and seat comer 38, when seat 10 is collapsed inwardly about axis A. When seat 10 is in the fully deployed position, that is, when seat fabric 44 is suitably tensioned for comfortable sitting, telescoping vertical supports 20 and 22 are fully collapsed. Thus a weight, for example, that of a user, suspended in seat fabric 44 may be in part supported by a compression loading of outer tubes or sleeves 20*b* and 22*b* when supports 20 and 22 are telescopically compressed so as to contain the entire length of telescoping rods 20*a* and 22*a* within sleeves 20*b* and 22*b* respectively.

As illustrated in FIGS. 7*a*, 7*b*, and 8*a*, 8*b*, telescoping supports 20 and 22 may include a button lock 48. Button lock 48 locks the corresponding "X"-shaped structure into its deployed position. Each button lock 48 includes spring 48*a* mounted in the telescoping rod for urging pivotable latch arm 48*c* through an elongate aperture in the rod for latching engagement through a corresponding elongate slot 48*b* in the sleeve sliding over the rod. The latch arm 48*c* and the slot 48*b* in the sleeve align when the telescoping vertical support is fully collapsed so that a compressive loading applied to the support is born against the corresponding foot. Button lock 48 operates on the same principle as an umbrella extension lock. Thus telescoping supports 20 and 22 both limit the compression of the "X"-shaped structures under weight loading and, with the assistance of the button locks, help to keep folding chair 10 fully deployed when a user repositions chair under themselves, for example as will happen when a user pulls the chair closer to a table while still sitting in the chair.

Figure 6:
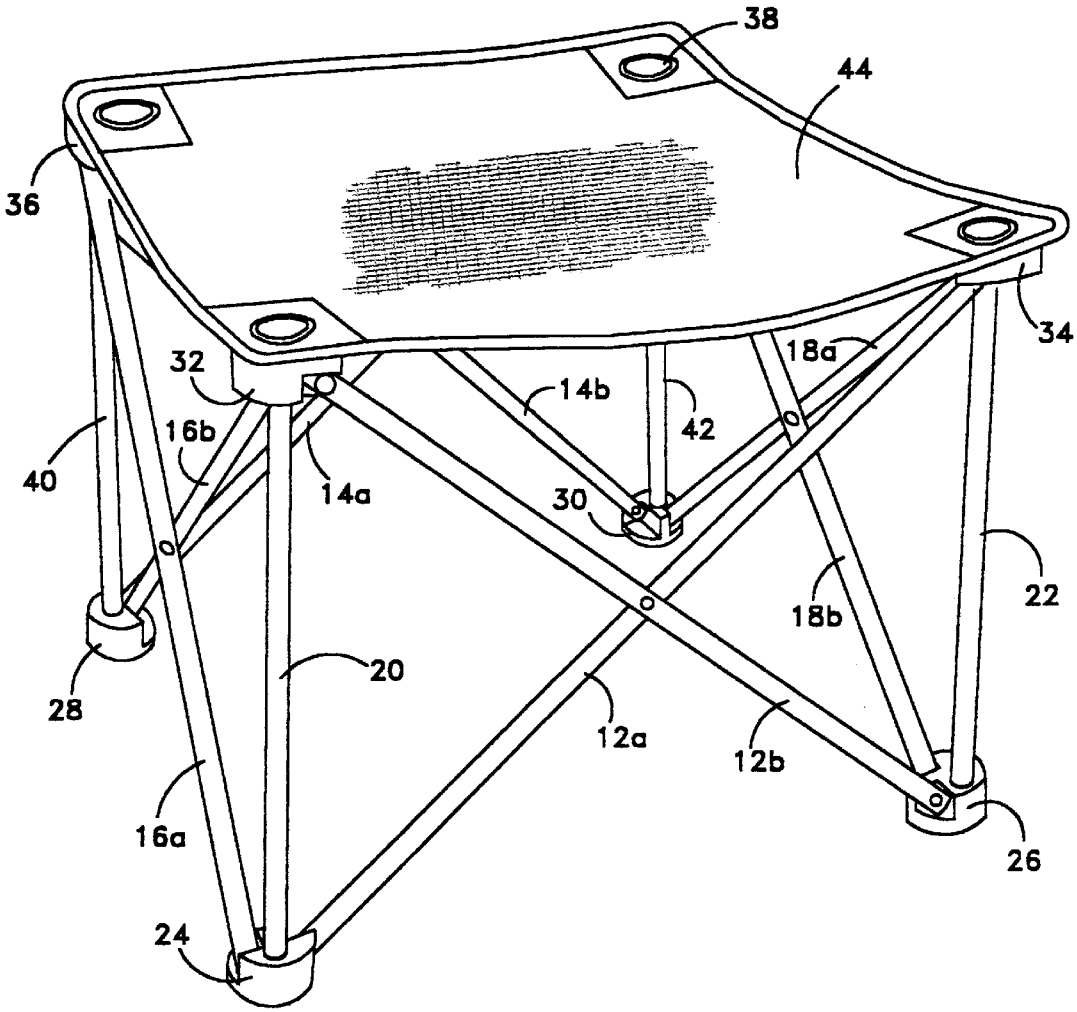
FIG. 6 is a perspective view of the folding chair of the present invention in a secondary embodiment with telescopic supports on all four corners.
Figure 7A:
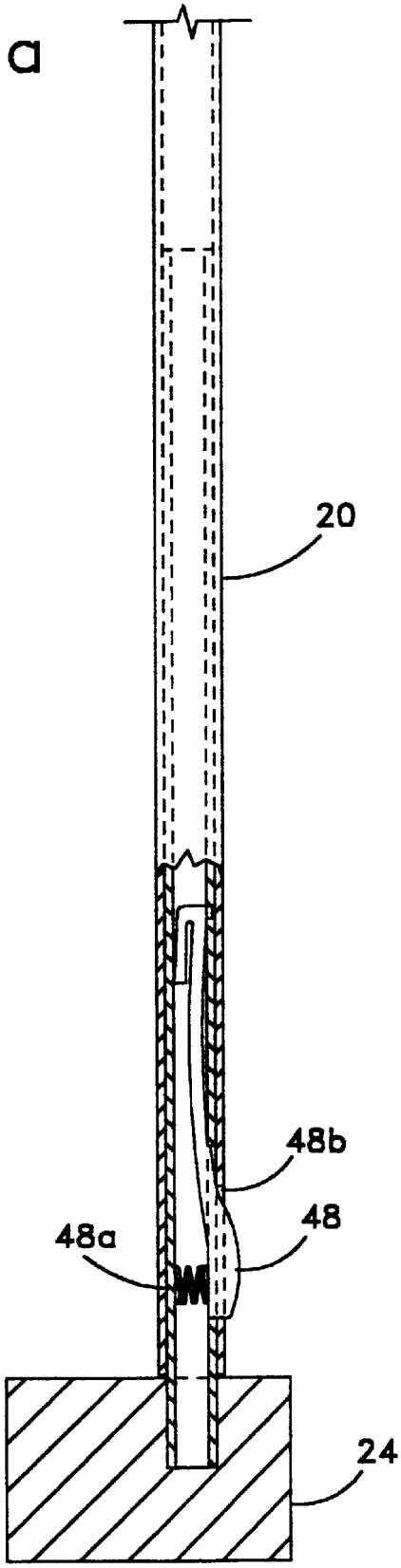
FIG. 7*a* is a close up side cutaway view of the telescopic supports showing the button lock as may be used to lock the telescopic supports when the chair is deployed.
Figure 7B:
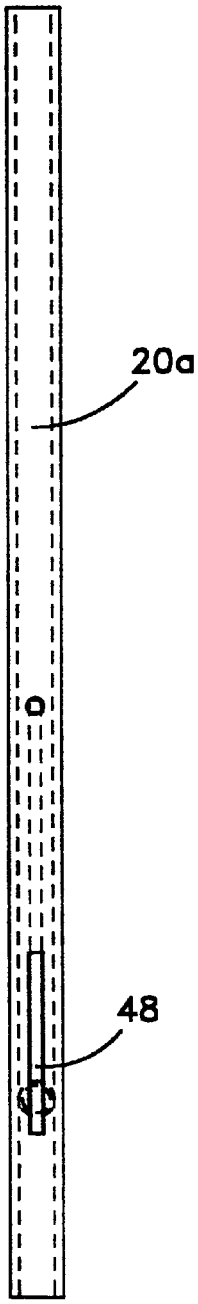
FIG. 7*b* is a close up front view of the internal telescopic supports rod with button lock.
Figure 8A:
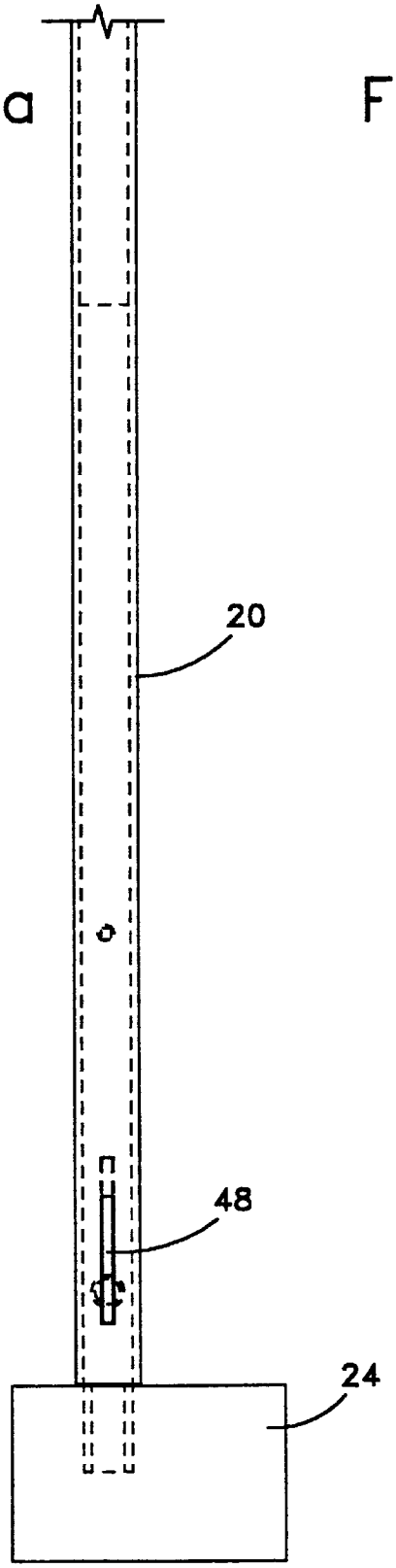
FIG. 8*a* is a close up front view of the telescopic supports showing the button lock as may be used to lock the telescopic supports when the chair is deployed.
Figure 8B:
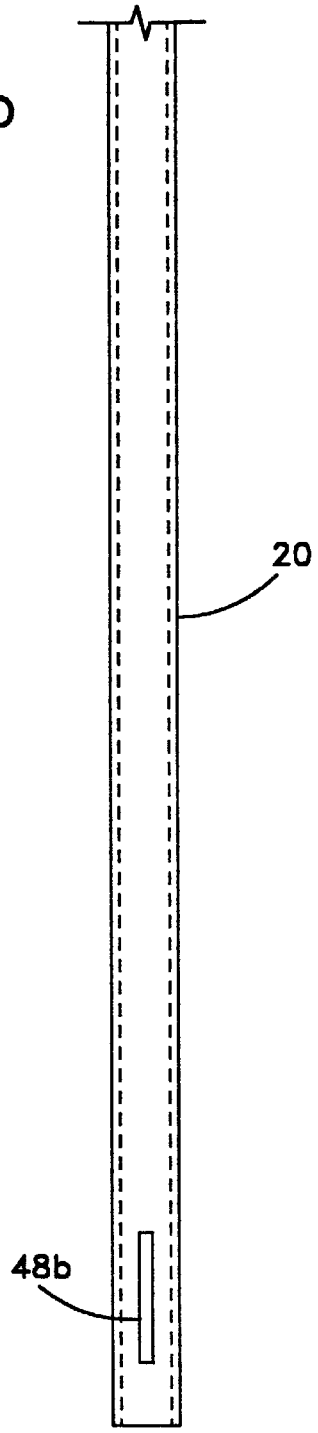
FIG. 8*b* is a close up front view of the external telescopic supports tube showing the slot for the button lock.
Figure 9:
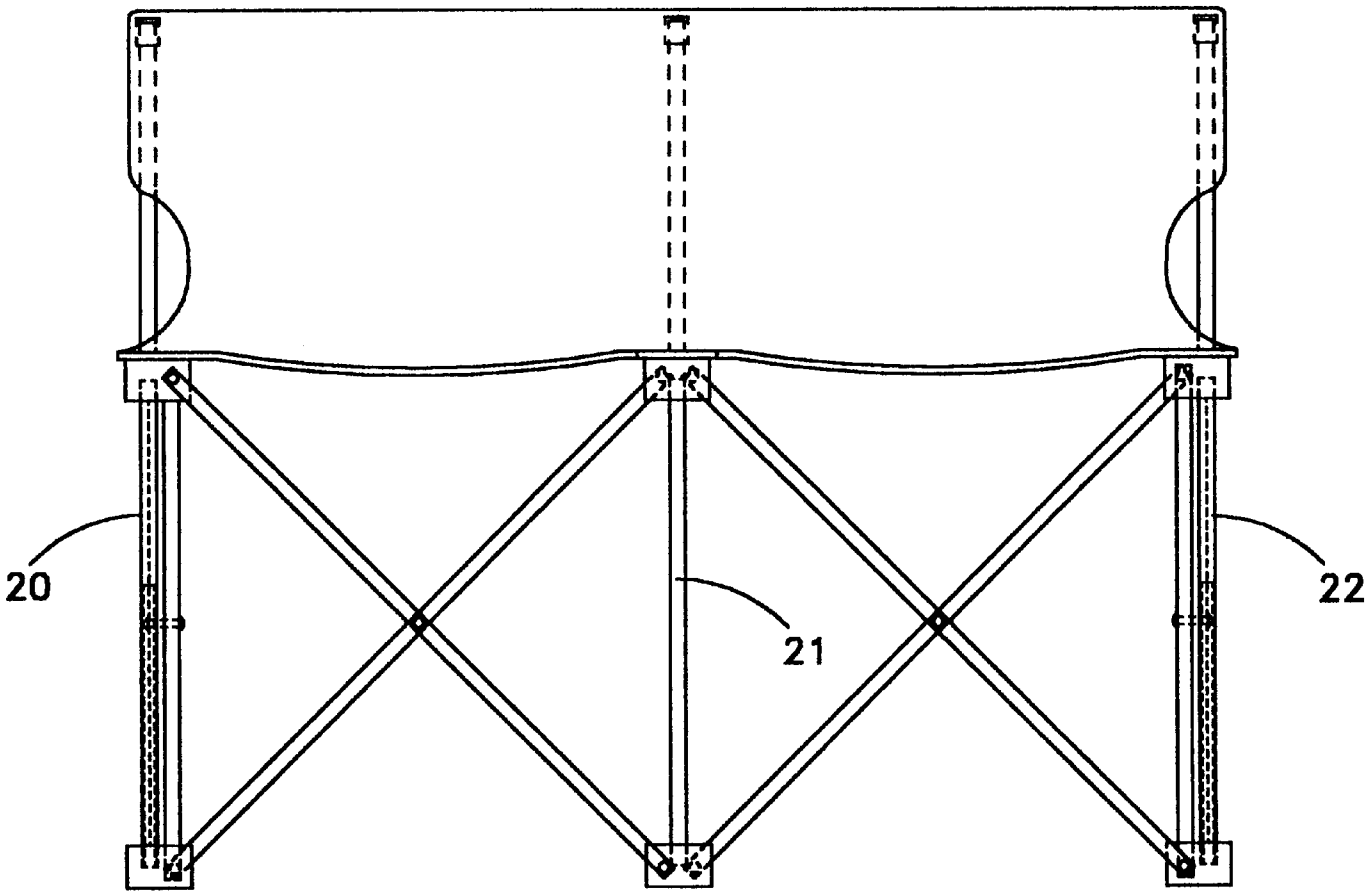
FIG. 9 is a front elevation view of an alternate embodiment with telescopic supports used in three places and showing a love chair deployed.

As shown in FIG. 6, telescoping supports 20 and 22 may be used on a stool 50. In this case telescoping supports are used on all four corners. Each telescoping support may include a button lock 48 to lock the "X"-shaped structure in the deployed position, allowing stool 50 to be used as a table. Telescoping supports and corresponding button locks 48 keep flexible seat 52 taut for supporting objects (not shown).

In operation, a user grasps front seat corners 32 and 34, or front feet 28 and 30, moving them away from each other, expanding each "X"-shaped structure away from axis A, until the expansion of structures 12, 14, 16 and 18, is limited by the tensioning of the seat fabric and the telescopic collapse of the vertical supports. To collapse seat 10 the steps are reversed, each "X"-shaped structure collapsing about axis A radially inwardly.

Forces from seat 44 imparted to front and rear feet 24, 26, 28 and 30, through "X"-shaped structures 12, 14, 16 and 18 and upright telescopic supports 20 and 22. Use of supports 20 and 22 relieve the various other components of significant loading.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

What is claimed is:

1. A folding chair comprising:

"X"-shaped collapsible front and rear structures,

"X"-shaped collapsible left and right side structures, said front, rear, left side and right side structures pivotally mounted to each other at adjoining corners of said "X"-shaped structures so that said front and rear structures are parallel and spaced apart and so that said left and right side structures are parallel and spaced apart, said front, rear, left and right side structures when so mounted defining a rectangular parallelepiped symmetric about an axis of symmetry, said rectangular parallelepiped expandable or collapsible symmetrically about said axis of symmetry by simultaneous corresponding expansion or collapsing of said "X"-shaped structures about pivots in the center of each said "X"-shaped structure and said pivotable mounting at said adjoining corners, said adjoining corners forming the vertices of said rectangular parallelepiped, one pair only of telescopic members mounted to, so as to extend between, vertically aligned front vertices of said vertices of said rectangular parallelepiped, wherein said telescopic members are fully telescopically retracted when said rectangular parallelepiped is fully expanded so as to tension a flexible seat suspended between upper vertices of said vertices of said rectangular parallelepiped.

2. The folding chair of claim 1 wherein said telescopic members are mounted between vertically aligned front vertices of said vertices of said rectangular parallelepiped.

3. The folding chair of claim 2 wherein said telescopic members are a pair of parallel linearly telescopic members telescopically extendable and retractable between fully extended positions when said rectangular parallelepiped is fully collapsed about said axis of symmetry, and fully retracted positions when said rectangular parallelepiped is fully expanded.

4. The folding chair of claim 1 wherein said telescopic members further comprise a releasable lock mounted thereon to releasably lock said telescopic members in said fully retracted position.

5. A folding chair comprising:

a) a front transverse "X"-shaped structure formed by first and second rigid members pivotally coupled scissor-like together at midpoints along the first and second members and extending downwardly to front feet and upwardly to front seat corners of said chair;

b) a rear transverse "X"-shaped structure formed by third and fourth rigid members pivotally coupled scissor-like together at midpoints along the third and fourth members and extending downwardly to rear feet and upwardly to rear seat corners of the chair;

c) left and right side "X"-shaped structures each a scissor-like pivotally coupled pair of crossed rigid members, each pair of crossed rigid members having upper and lower oppositely disposed ends pivotally mounted to corresponding ends of said first, second, third and fourth rigid members when said front and rear transverse "X"-shaped structures and said left and right "X"-shaped structures are mounted to one another so as to define a rectangular parallelepiped between said corresponding ends, a sling seat mounted between upper vertices thereof;

d) one pair only of telescopic upright supports mounted to, so as to extend between, a pair of front corners of said sling seat and said front feet, said pair of front corners of said sling seat and said front feet substantially vertically aligned.

6. The folding chair of claim 5 and further comprising rear uprights mounted to said rear feet and slidably mounted to rear seat corners of said sling seat.

7. The folding chair of claim 6 wherein said rear uprights extend above said sling seat to support a backrest mounted therebetween.

8. The folding chair of claim 5 wherein said telescopic upright supports further comprise a lock mounted therein for releasably locking said at least one telescopic upright supports in a fully retracted position whereby said sling seat is kept taut when said chair is deployed.

9. In a cross-legged folding chair, an improved leg supporting apparatus comprising one pair only of upstanding telescopic members mounted to, so as to extend between, first front corners of a seat portion of said chair and corresponding front feet of said chair, said upstanding telescopic members telescopically retracted into a fully retracted position when said chair is unfolded so as to be fully deployed.

10. The folding chair of claim 9 wherein said upstanding telescopic members are vertical.

11. The folding chair of claim 9 wherein said upstanding telescopic members further comprise a releasable lock mounted thereon to releasably lock said upstanding telescopic members in said fully retracted position.

* * * * *